US009297572B2

(12) United States Patent
Bischoff et al.

(10) Patent No.: US 9,297,572 B2
(45) Date of Patent: Mar. 29, 2016

(54) APPLIANCE WITH AN ARTICULATING HANDLE

(71) Applicant: General Electric Company, Schenectady, NY (US)

(72) Inventors: Stephen Michael Bischoff, Louisville, KY (US); Eugenio Gomez, Louisville, KY (US); Sanjay Pallipurath Sreenarayanan, Hyderabad (IN); Sandip Kashinathappa Shetty, Hyderabad (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/251,930

(22) Filed: Apr. 14, 2014

(65) Prior Publication Data

US 2015/0292793 A1 Oct. 15, 2015

(51) Int. Cl.
*F25D 23/02* (2006.01)
*E05B 17/00* (2006.01)

(52) U.S. Cl.
CPC ..... *F25D 23/028* (2013.01); *E05B 17/0033* (2013.01); *F25D 2323/021* (2013.01); *Y10T 16/458* (2015.01)

(58) Field of Classification Search
CPC .... E05B 1/0015; E05B 17/0033; E05F 11/10; F25D 23/028; F25D 2323/021; Y10T 16/458; Y10T 16/459; Y10T 16/462; Y10T 16/464; Y10S 292/53; Y10S 292/54
USPC ..... 312/401, 402, 404, 405, 296, 332.1; 16/436, 444, 412; 292/336.3
See application file for complete search history.

(56) References Cited

U.S. PATENT DOCUMENTS

| | | | | | |
|---|---|---|---|---|---|
| 4,497,514 | A * | 2/1985 | Moriya et al. | 292/336.3 | |
| 4,546,628 | A * | 10/1985 | Takasaki | 70/92 | |
| 4,880,261 | A * | 11/1989 | Bisbing | E05C 9/08 | 292/66 |
| 5,154,460 | A * | 10/1992 | Bartsch | 292/336.3 | |
| 5,169,185 | A * | 12/1992 | Slaybaugh et al. | 292/92 | |
| 5,613,717 | A * | 3/1997 | Ha | 292/336.3 | |
| 5,651,163 | A * | 7/1997 | Tamaki | 292/336.3 | |
| 5,688,001 | A * | 11/1997 | Klein | E05C 19/14 | 292/63 |
| 5,794,994 | A * | 8/1998 | Miyagawa et al. | 292/336.3 | |
| 5,908,228 | A * | 6/1999 | Lee | 312/405 | |
| 6,203,076 | B1 * | 3/2001 | Wytcherley et al. | 292/202 | |
| 6,957,979 | B2 * | 10/2005 | Welsh et al. | 439/565 | |
| 7,201,407 | B2 * | 4/2007 | Schlack | E05B 9/08 | 292/139 |
| 7,234,735 | B2 * | 6/2007 | Harada | E05C 5/00 | 292/170 |
| 7,261,340 | B2 * | 8/2007 | Wang | E05B 17/0025 | 292/241 |
| 7,343,646 | B2 * | 3/2008 | Hayashi | 16/412 | |
| 7,364,211 | B2 * | 4/2008 | Niskanen et al. | 292/336.3 | |
| 7,397,674 | B2 * | 7/2008 | Schlack | 361/801 | |
| 7,695,206 | B2 * | 4/2010 | Kawakami | B41J 3/4075 | 292/101 |
| 7,765,645 | B2 | 8/2010 | Kim | | |
| 7,984,955 | B2 * | 7/2011 | Jung et al. | 312/405 | |

(Continued)

FOREIGN PATENT DOCUMENTS

EP 2562498 2/2013

*Primary Examiner* — Daniel J Troy
*Assistant Examiner* — Hiwot Tefera
(74) *Attorney, Agent, or Firm* — Dority & Manning, PA

(57) ABSTRACT

An appliance is provided. The appliance includes a cabinet, a door mounted to the cabinet and a handle. The appliance also includes features for pivotally mounting the handle to the door and for urging the door away from the cabinet when the handle pivots. The features can also assist with limiting or reducing a gap between the handle and the door.

17 Claims, 12 Drawing Sheets

(56) References Cited

U.S. PATENT DOCUMENTS

| | | | | |
|---|---|---|---|---|
| 8,025,349 | B2 * | 9/2011 | Lim et al. | 312/405 |
| 8,523,302 | B2 * | 9/2013 | Shin et al. | 312/405 |
| 2005/0023838 | A1 * | 2/2005 | Schlack | E05B 9/08 292/66 |
| 2005/0200253 | A1 * | 9/2005 | Wissinger et al. | 312/405 |
| 2006/0103140 | A1 * | 5/2006 | Bella et al. | 292/95 |
| 2008/0000052 | A1 * | 1/2008 | Hong et al. | 16/382 |
| 2009/0179540 | A1 * | 7/2009 | Seo | 312/405 |
| 2011/0227350 | A1 * | 9/2011 | Do | 292/105 |
| 2011/0241512 | A1 * | 10/2011 | Jung et al. | 312/405 |
| 2011/0273070 | A1 * | 11/2011 | Shin et al. | 312/405 |
| 2011/0317345 | A1 * | 12/2011 | Huang | G06F 1/1613 361/679.01 |
| 2012/0280608 | A1 * | 11/2012 | Park et al. | 312/405 |
| 2013/0270990 | A1 * | 10/2013 | Park et al. | 312/404 |

* cited by examiner

APPLIANCE WITH AN ARTICULATING HANDLE

FIELD OF THE INVENTION

The present subject matter relates generally to appliances, such as appliances with articulating handles.

BACKGROUND OF THE INVENTION

Certain appliances include a cabinet and a door. The door is mounted to the cabinet such that the door permits selective access to an interior of the cabinet. For example, bottom mount refrigerator appliances generally include upper refrigerator doors that permit selective access to an upper fresh food chamber and a lower freezer door that permits selective access to a lower freezer chamber. Due a low pressure atmosphere within the freezer chamber, opening the lower freezer door can be difficult and/or challenging.

Certain bottom mount refrigerator appliances include a pivoting handle coupled to a slider to assist with opening the lower freezer door despite the low pressure atmosphere within the freezer chamber. In such refrigerator appliances, the pivoting handle is secured to the door such that the pivoting handle is rotatable about a fixed axis, and the slider is coupled to the pivoting handle such that the slider engages the refrigerator appliances' cabinet and pushes the lower freezer door away from the cabinet when the pivoting handle is rotated. In such a manner, the pivoting handle can assist with opening the lower freezer door. However, such pivoting handles have certain drawbacks. In particular, a substantial gap between the pivoting handle and the lower freezer door is generally required to prevent the pivoting handle from impacting the lower freezer door during rotation of the pivoting handle, and the gap between the pivoting handle and the lower freezer door can be cosmetically unappealing or unattractive.

Accordingly, an appliance with features for assisting with opening a door of the appliance would be useful. In particular, a bottom mount refrigerator appliance with features for assisting with opening a lower freezer door of the bottom mount refrigerator appliance would be useful. In addition, an appliance with features for assisting with opening a door of the appliance and for limiting a gap between a handle of the appliance and the door would be useful.

BRIEF DESCRIPTION OF THE INVENTION

The present subject matter provides an appliance. The appliance includes a cabinet, a door mounted to the cabinet and a handle. The appliance also includes features for pivotally mounting the handle to the door and for urging the door away from the cabinet when the handle pivots. The features can also assist with limiting or reducing a gap between the handle and the door. Additional aspects and advantages of the invention will be set forth in part in the following description, or may be apparent from the description, or may be learned through practice of the invention.

In a first exemplary embodiment, an appliance is provided. The appliance includes a cabinet that defines an interior volume. A door is mounted to the cabinet such that the door permits selective access to the interior volume of the cabinet. The door has an outer panel that defines an opening. The appliance also includes a handle and an articulation assembly. The articulation assembly includes a housing assembly positioned within the door at the opening of the outer panel. The housing assembly defines a first pair of slots and a second pair of slots. A handle anchor has a first pair of projections and a second pair of projections. Each projection of the first pair of projections is received within a respective one of the first pair of slots of the housing assembly. Each projection of the second pair of projections is received within a respective one of the second pair of slots of the housing assembly. The handle is mounted to the handle anchor. A lever is rotatably mounted to the housing assembly and coupled to the handle anchor. A slider assembly is coupled to the lever and extends towards the cabinet.

In a second exemplary embodiment, a bottom mount refrigerator appliance is provided. The bottom mount refrigerator appliance includes a cabinet that defines an upper fresh food chamber and a lower freezer chamber. A freezer door is slidably positioned at the lower freezer chamber of the cabinet. The freezer door has an outer panel that defines an opening. The bottom mount refrigerator also includes a handle and an articulation assembly. The articulation assembly includes a housing assembly positioned within the freezer door at the opening of the outer panel. The housing assembly defines a first pair of slots and a second pair of slots. A handle anchor has a first pair of projections and a second pair of projections. Each projection of the first pair of projections is received within a respective one of the first pair of slots of the housing assembly. Each projection of the second pair of projections is received within a respective one of the second pair of slots of the housing assembly. The handle is mounted to the handle anchor. A lever is rotatably mounted to the housing assembly and coupled to the handle anchor. A slider assembly is coupled to the lever and extends towards the cabinet.

In a third exemplary embodiment, an appliance is provided. The appliance includes a cabinet, a door mounted to the cabinet and a handle. The appliance also includes means for pivotally mounting the handle to the door and for urging the door away from the cabinet when the handle pivots.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
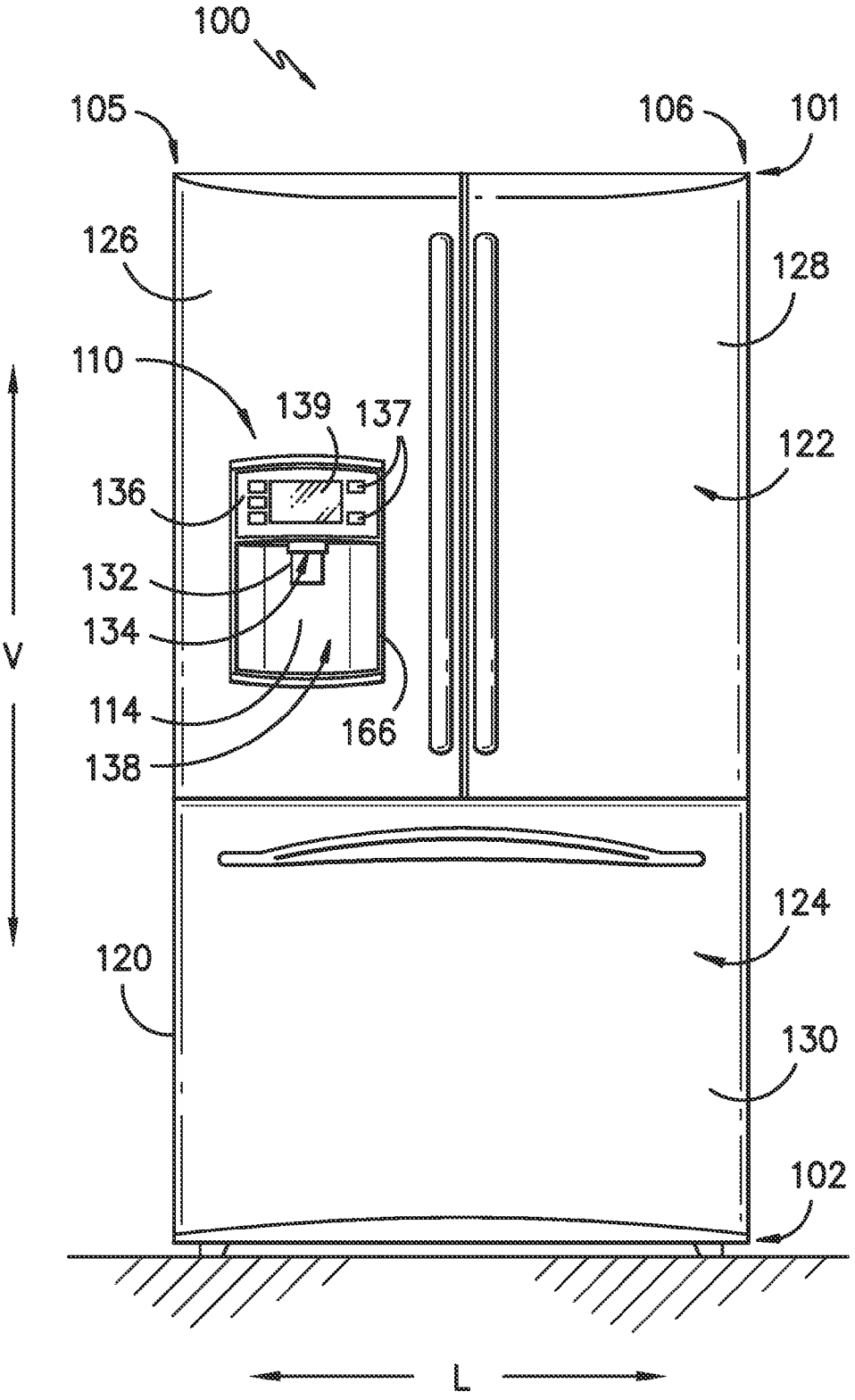
FIG. 1 provides a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
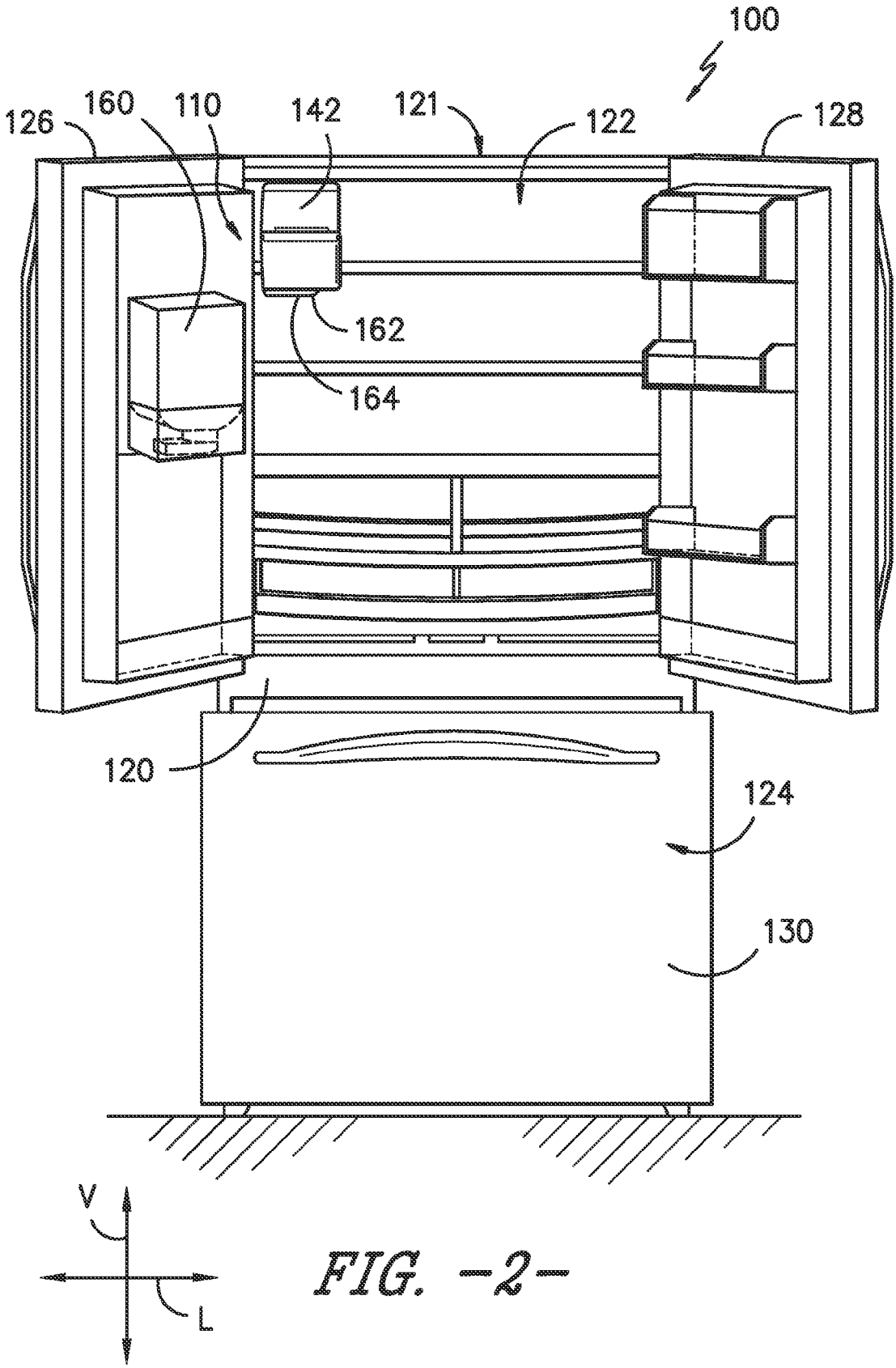
FIG. 2 provides a front, elevation view of the exemplary refrigerator appliance of FIG. 1 with refrigerator doors of the exemplary refrigerator appliance shown in an open configuration to reveal a fresh food chamber of the exemplary refrigerator appliance.

FIG. 1 provides a front, elevation view of a refrigerator appliance 100 according to an exemplary embodiment of the present subject matter. FIG. 2 provides a front, elevation view of refrigerator appliance 100 with refrigerator doors 126 and 128 of refrigerator appliance 100 shown in an open position to reveal a fresh food chamber 122 of refrigerator appliance 100. Refrigerator appliance 100 defines a vertical direction V and a lateral direction L. The vertical direction V and lateral direction L are perpendicular to each other. Refrigerator appliance 100 extends between an upper portion 101 and a lower portion 102 along the vertical direction V. Refrigerator appliance 100 also extends between a first side portion 105 and a second side portion 106 along the lateral direction L.

Refrigerator appliance 100 includes a cabinet or housing 120 that defines chilled chambers for receipt of food items for storage. In particular, refrigerator appliance 100 defines fresh food chamber 122 at upper portion 101 of refrigerator appliance 100 and a freezer chamber 124 arranged below fresh food chamber 122 on the vertical direction V, e.g., at lower portion 102 of refrigerator appliance 100. As such, refrigerator appliance 100 is generally referred to as a bottom mount refrigerator appliance. However, using the teachings disclosed herein, one of skill in the art will understand that the present subject matter may be used with other types of refrigerator appliances (e.g., side-by-side style or top mount style) or a freezer appliance as well. Consequently, the description set forth herein is for illustrative purposes only and is not intended to limit the present subject matter in any aspect.

Refrigerator doors 126 and 128 are rotatably hinged to an edge of housing 120 for accessing fresh food compartment 122. In particular, refrigerator doors 126 and 128 are rotatably mounted to housing 120 at an opening 121 that permits access to fresh food chamber 122. A freezer door 130 is arranged below refrigerator doors 126 and 128 for accessing freezer chamber 124. Freezer door 130 is coupled to a freezer drawer (not shown) slidably mounted within freezer chamber 124.

Refrigerator appliance 100 also includes a dispensing assembly 110 for dispensing liquid water and/or ice. Dispensing assembly 110 includes a dispenser 114 positioned on or mounted to an exterior portion of refrigerator appliance 100, e.g., on refrigerator door 126. Dispenser 114 includes a discharging outlet 134 for accessing ice and liquid water. An actuating mechanism 132, shown as a paddle, is mounted below discharging outlet 134 for operating dispenser 114. In alternative exemplary embodiments, any suitable actuating mechanism may be used to operate dispenser 114. For example, dispenser 114 can include a sensor (such as an ultrasonic sensor) or a button rather than the paddle. A user interface panel 136 is provided for controlling the mode of operation. For example, user interface panel 136 includes a plurality of user inputs 137, such as a water dispensing button (not labeled) and an ice-dispensing button (not labeled), for selecting a desired mode of operation such as crushed or non-crushed ice. User interface panel 136 also includes a display 139 for presenting information to a user of refrigerator appliance 100.

Discharging outlet 134 and actuating mechanism 132 are an external part of dispenser 114 and are mounted in a dispenser recess 138 defined by a dispenser body 166 of dispenser 114. Dispenser body 166 is mounted to refrigerator door 126, e.g., at an outside surface of refrigerator door 126. Dispenser recess 138 is positioned at a predetermined elevation convenient for a user to access ice or water and enabling the user to access ice without the need to bend-over and without the need to access freezer chamber 124. In the exemplary embodiment, dispenser recess 138 is positioned at a level that approximates the chest level of a user.

Turning now to FIG. 2, certain components of dispensing assembly 110 are illustrated. Dispensing assembly 110 includes an insulated housing 142 mounted within fresh food chamber 122. Due to the insulation which encloses insulated housing 142, the temperature within insulated housing 142 can be maintained at levels different from the ambient temperature in the surrounding fresh food chamber 122.

Insulated housing 142 is constructed and arranged to operate at a temperature that facilitates producing and storing ice. More particularly, insulated housing 142 contains an ice maker for creating ice and feeding the same to a bucket 160 that is mounted on refrigerator door 126. As illustrated in FIG. 2, bucket 160 is placed at a vertical position on refrigerator door 126 that will allow for the receipt of ice from a discharge opening 162 located along a bottom edge 164 of insulated housing 142. As refrigerator door 126 is closed or opened, bucket 160 is moved in and out of position under insulated housing 142.

Operation of the refrigerator appliance 100 can be regulated by a controller (not shown) that is operatively coupled to user interface panel 136 and/or actuating mechanism 132. Panel 136 provides selections for user manipulation of the operation of refrigerator appliance 100 such as e.g., selections between whole or crushed ice, chilled water, and/or other options as well. In response to user manipulation of the user interface panel 136, the controller operates various components of the refrigerator appliance 100.

The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller may be positioned in a variety of locations throughout refrigerator appliance 100. In the illustrated embodiment, controller is located within the control panel area of refrigerator door 126. In such an embodiment, input/output ("I/O") signals may be routed between the controller and various operational components of refrigerator appliance 100. The user interface 136 may be in communication with the controller via one or more signal lines or shared communication busses.

Figure 3:
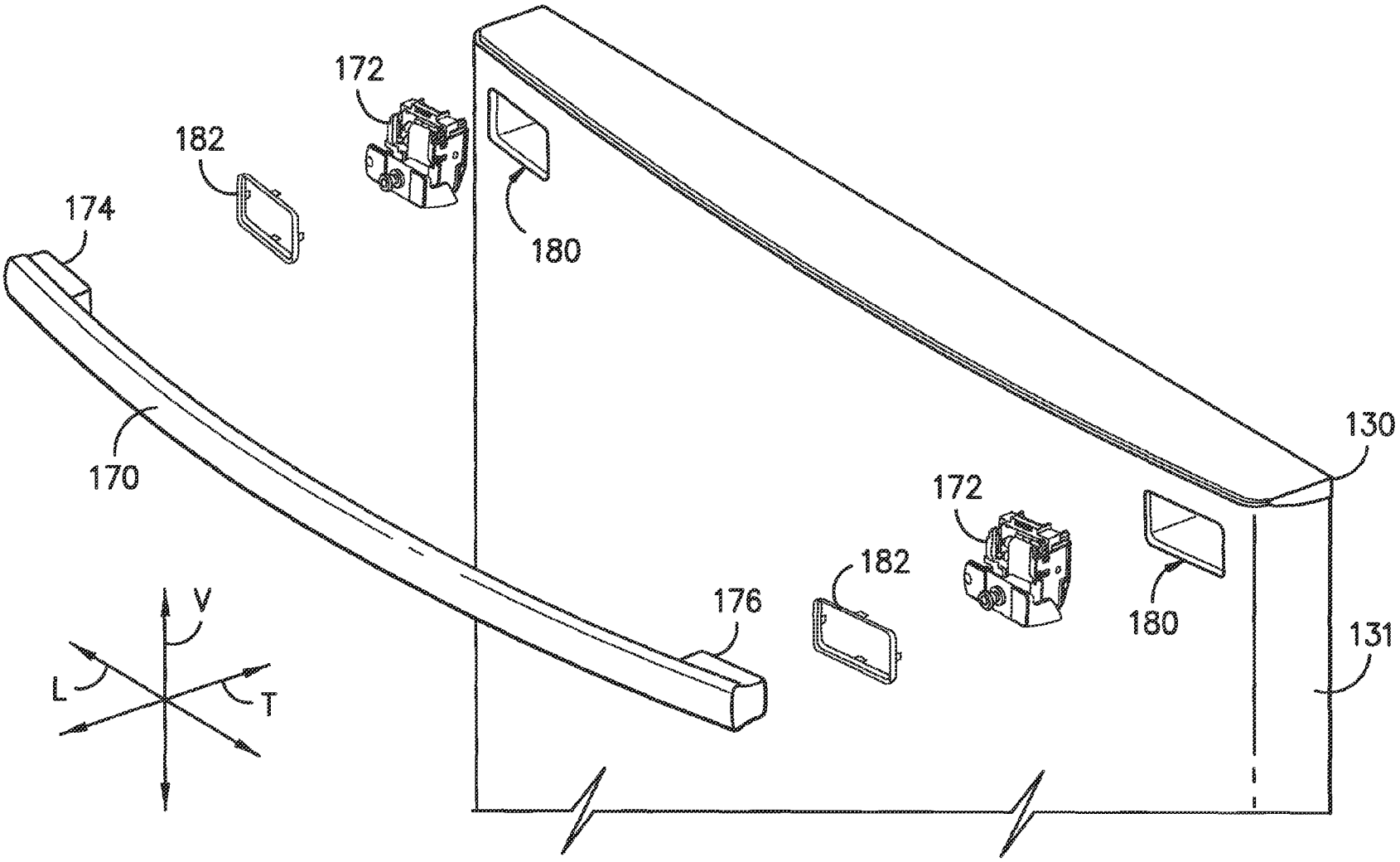
FIG. 3 provides an exploded view of certain components of the exemplary refrigerator appliance of FIG. 1.

FIG. 3 provides an exploded view of certain components of refrigerator appliance 100. As may be seen in FIG. 3, refrigerator appliance 100 includes a handle 170 and a pair of articulation assemblies 172. Articulation assemblies 172, e.g., pivotally, mount handle 170 to freezer door 130. In particular, handle 170 includes a first mounting foot 174 and a second mounting foot 176, e.g., that are spaced apart from each other along the lateral direction L. Thus, first and second mounting feet 174 and 176 of handle 170 may be positioned at opposite lateral ends of handle 170 as shown in FIG. 3. An outer panel 131 of freezer door 130 also defines a pair of openings 180, e.g., that are spaced apart from each other along the lateral direction L. Each articulation assemblies of articulation assemblies 172 is positioned and/or secured within freezer door 130 at a respective one of openings 180 of freezer door 130. In addition, first and second mounting feet 174 and 176 of handle 170 are mounted or secured to a respective one of articulation assemblies 172. At least a portion of first and second mounting feet 174 and 176 of handle 170 may be positioned or recessed within freezer door 130 at the respective one of openings 180 of freezer door 130. Freezer door 130 also includes a pair of opening trims 182. Each opening trim of opening trims 182 are mounted to outer panel 131 of freezer door 130 at a respective opening of openings 180 of freezer door 130.

Figure 4:
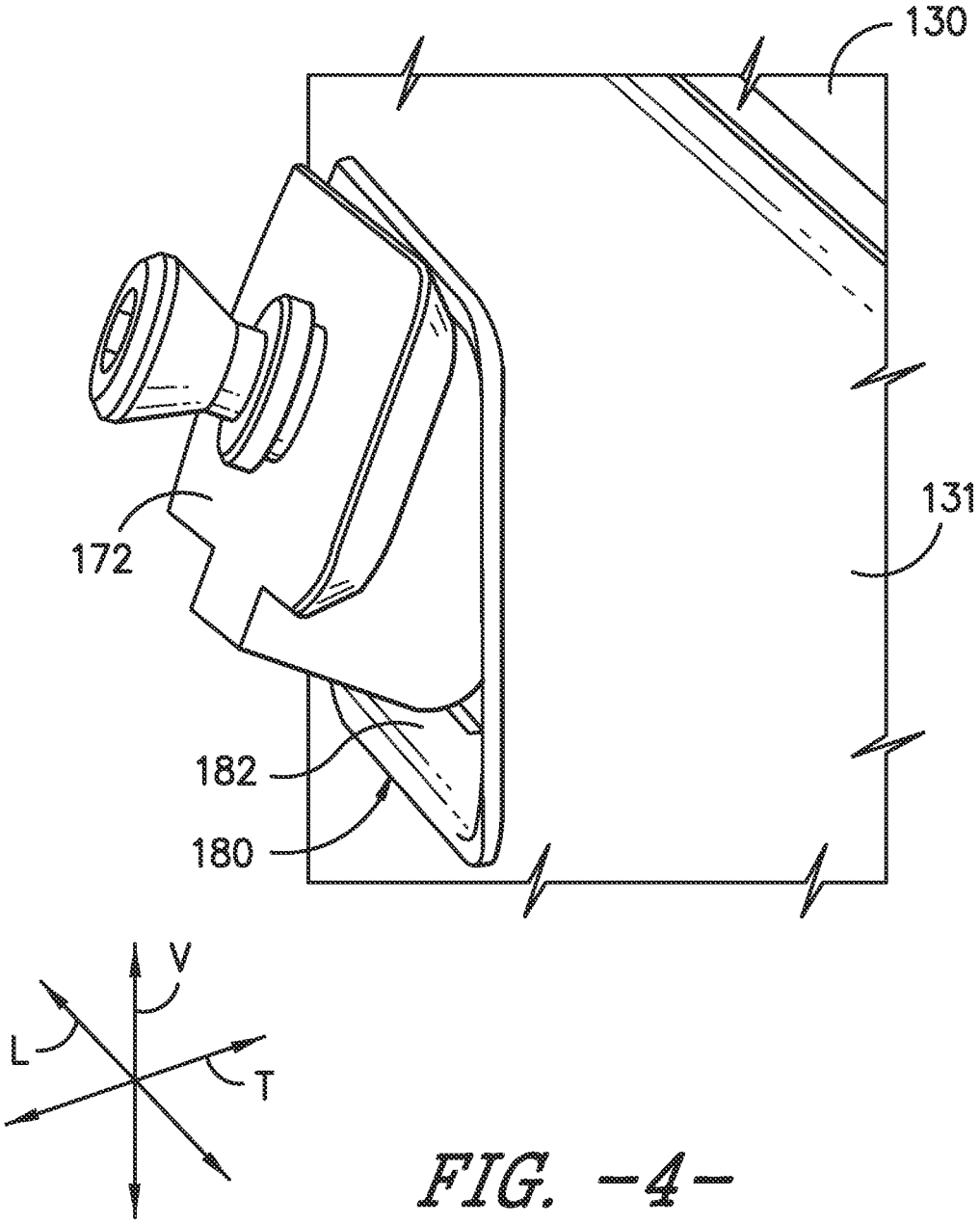
FIG. 4 provides a partial perspective view of an articulation assembly of the exemplary refrigerator appliance of FIG. 1 mounted within a freezer door of the exemplary refrigerator appliance.

FIG. 4 provides a partial perspective view of one of articulation assemblies 172 mounted within freezer door 130. As may be seen in FIGS. 3 and 4, articulation assemblies 172 are pivotable between a first position and a second position. Articulation assemblies 172 are shown in the first position in FIG. 3, and the one of articulation assemblies 172 is shown in the second position in FIG. 4. As discussed in greater detail below, articulation assemblies 172 may assist with opening freezer door 130 by pivoting from the first position towards the second position when freezer door 130 is closed. A user of refrigerator appliance 100 may shift or adjust articulation assemblies 172 between the first and second positions, e.g., by grasping and pivoting handle 170.

Figure 5:
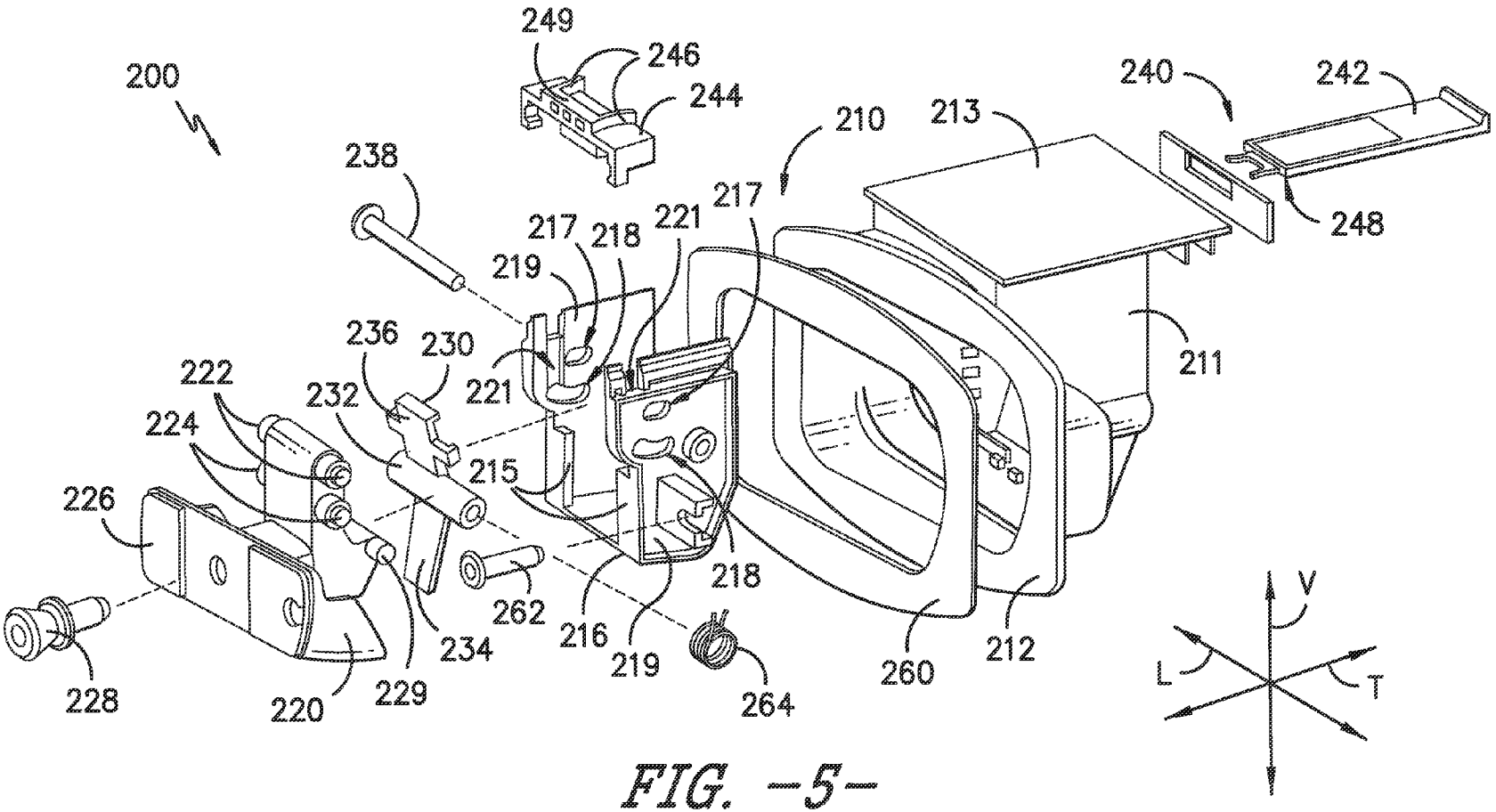
FIG. 5 provides an exploded view of an articulation assembly according to an exemplary embodiment of the present subject matter.
Figure 6:
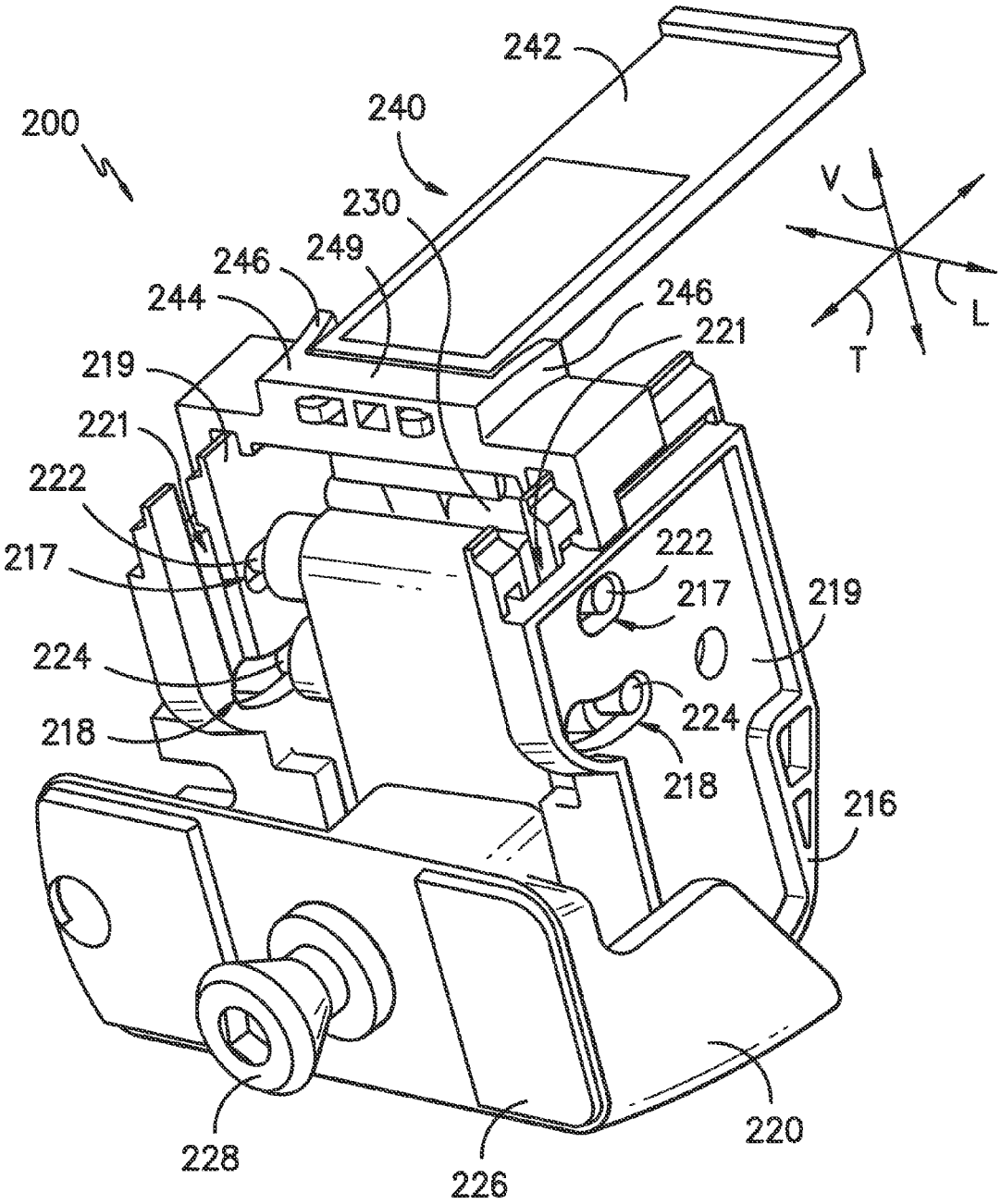
FIG. 6 provides a perspective view of the exemplary articulation assembly of FIG. 5.
Figure 7:
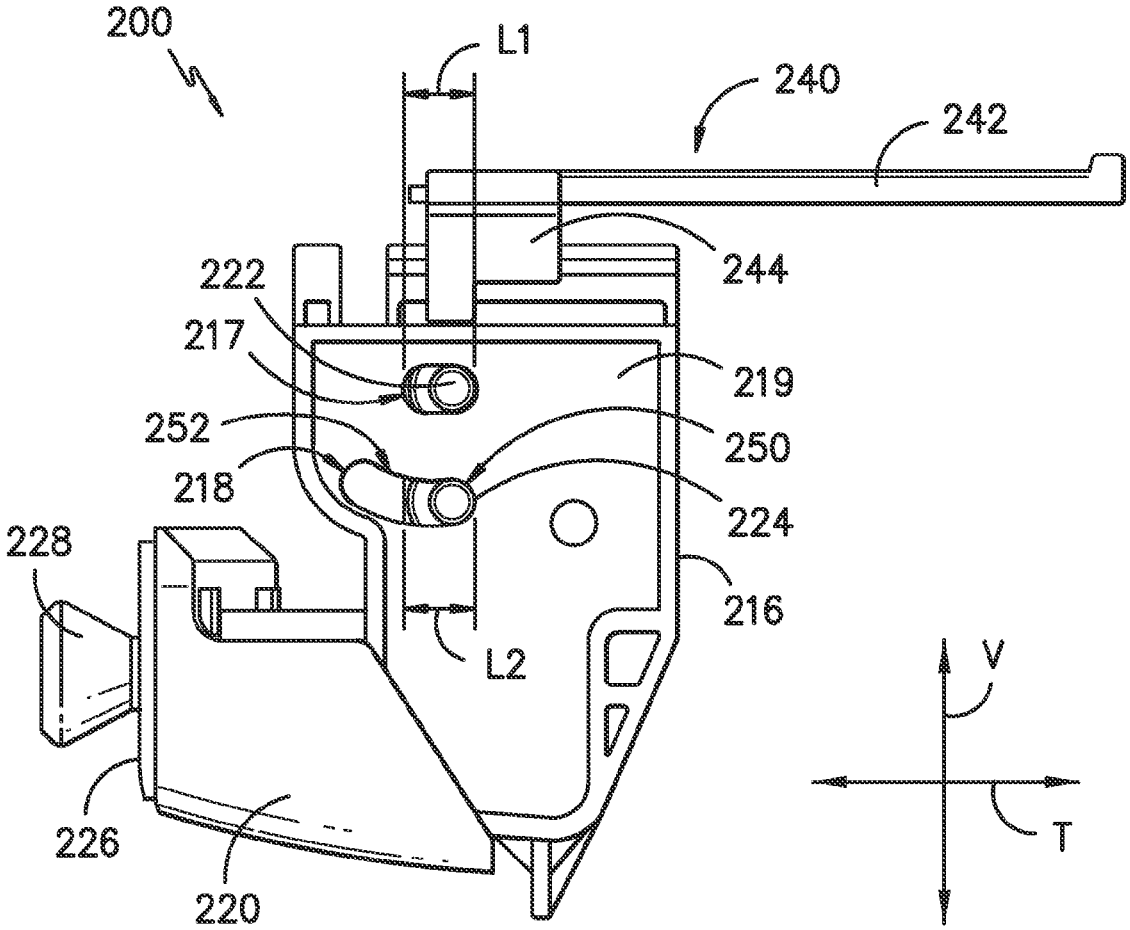
FIG. 7 provides a side, elevation view of the exemplary articulation assembly of FIG. 5.
Figure 8:
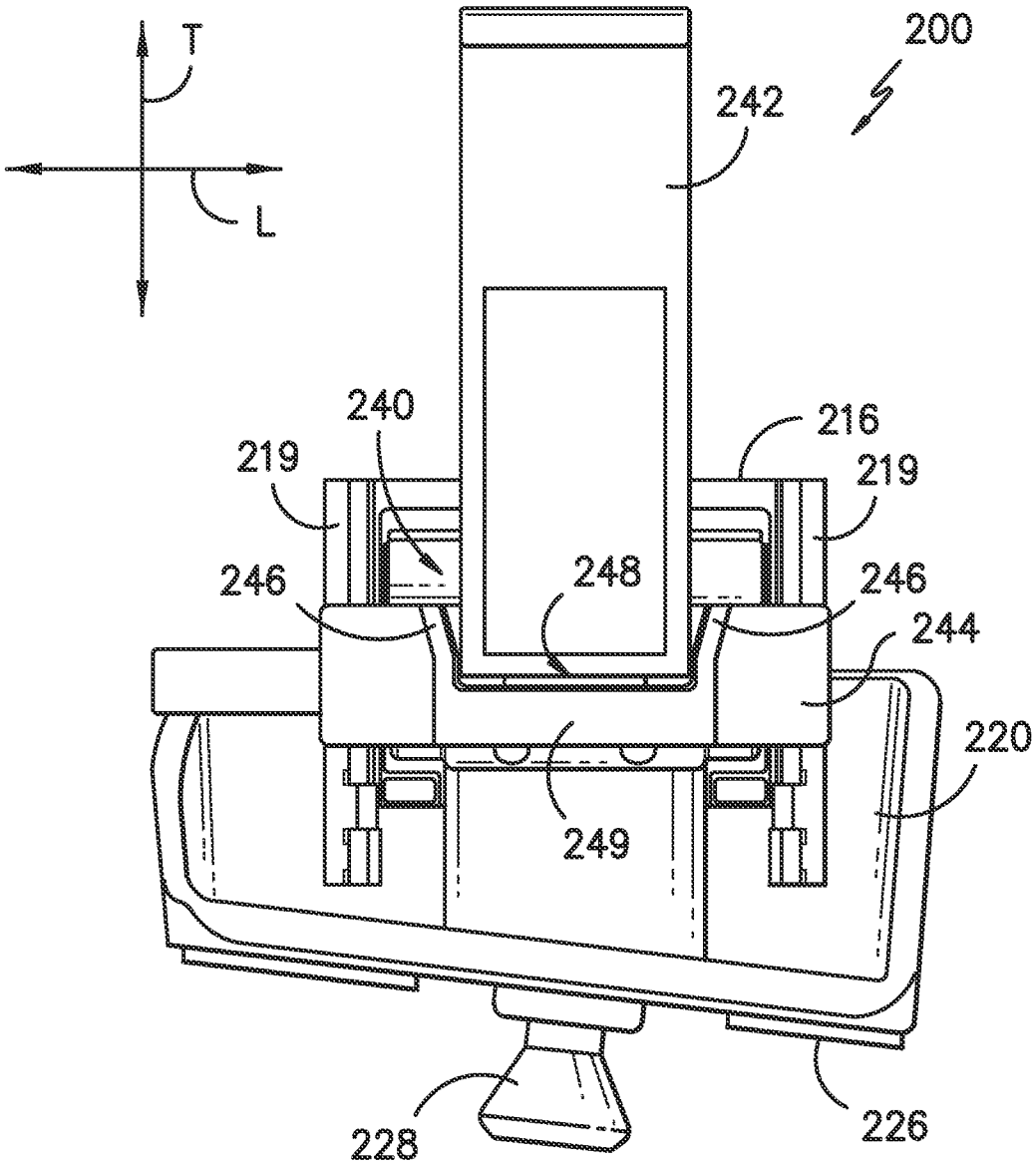
FIG. 8 provides a top, plan view of the exemplary articulation assembly of FIG. 5.
Figure 12:
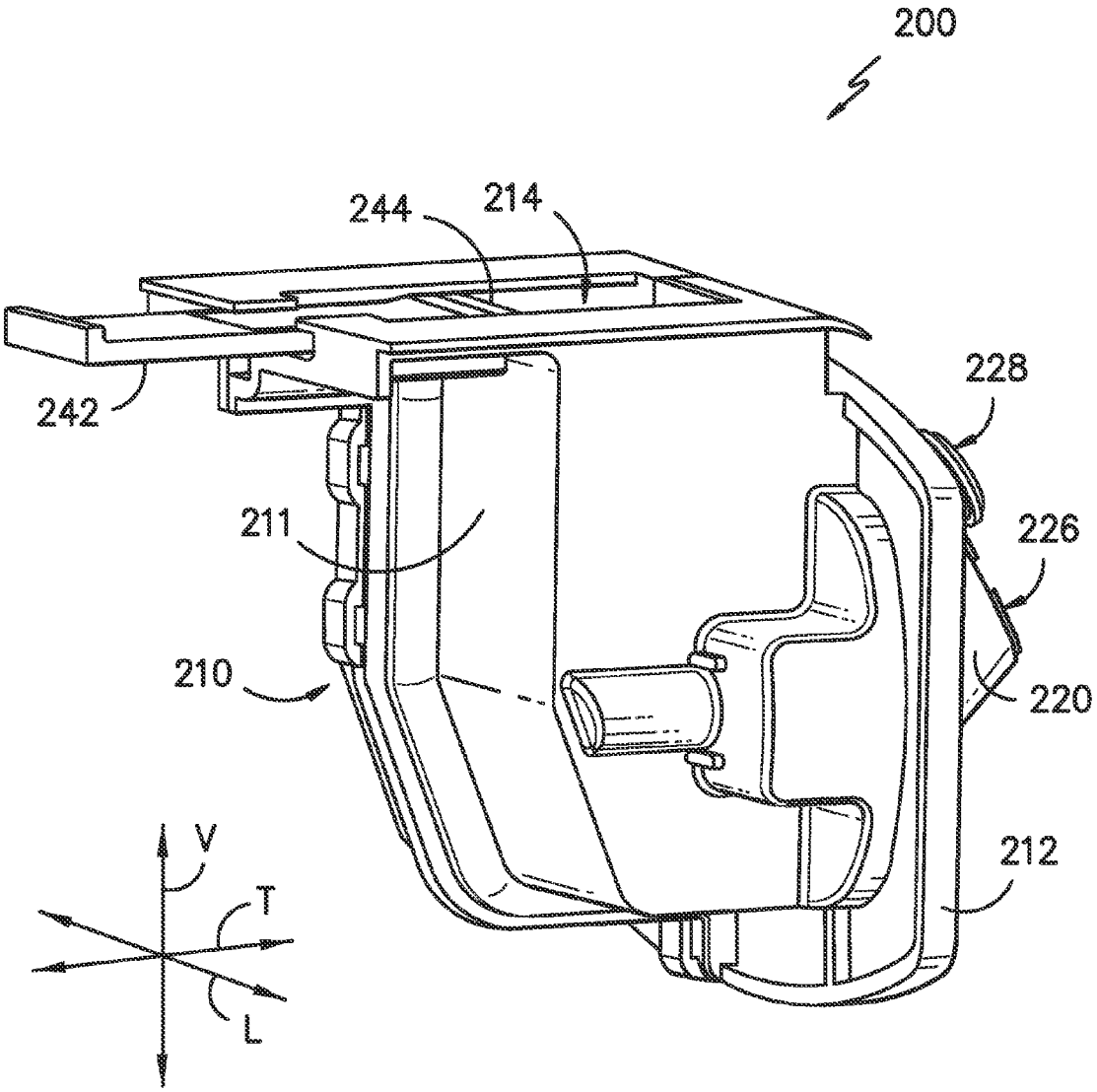
FIG. 12 provides a rear perspective view of the exemplary articulation assembly of FIG. 5.

FIG. 5 provides an exploded view of an articulation assembly 200 according to an exemplary embodiment of the present subject matter. FIG. 6 provides a perspective view of articulation assembly 200, FIG. 7 provides a side, elevation view of articulation assembly 200 and FIG. 8 provides a top, plan view of articulation assembly 200. FIG. 12 provides a rear perspective view of articulation assembly 200. Articulation assembly 200 may be used in any suitable appliance. For example, articulation assembly 200 may be used in refrigerator appliance 100 (FIG. 1) as one of articulation assemblies 172. As further examples, articulation assembly 200 may be used in a dishwasher appliance, a dryer appliance, etc. As discussed in greater detail below, articulation assembly 200 includes features for assisting with opening a door of an associated appliance and with pivotally mounting a handle of the associated appliance to a door of the associated appliance.

As may be seen in FIG. 5, articulation assembly 200 includes a housing assembly 210. When used in refrigerator appliance 100, housing assembly 210 may be positioned within freezer door 130, e.g., at one of openings 180 of freezer door 130 (FIG. 3). In the exemplary embodiment of FIG. 5, housing assembly 210 includes an outer housing 211 and an inner housing 216.

Outer housing 211 may be mounted or fixed within a door of an associated appliance. For example, outer housing 211 may be mounted or fixed within freezer door 130, e.g., at one of openings 180 of freezer door 130. To assist with properly positioning outer housing 211 within the door of the associate appliance, outer housing 211 includes a front plate 212 and a top plate 213. Front plate 212 and top plate 213 may be place on respective panels of the door of the associated appliance in order to suitably position and/or orient outer housing 211 within the door. For example, front plate 212 may be positioned on a rear surface of outer panel 131 of freezer door 130. Foam insulation may also at least partially surround or encase outer housing 211 within freezer door 130, e.g., in order to assist with securing outer housing 211 within freezer door 130. A gasket 260 may extend between front plate 212 and the rear surface of outer panel 131 of freezer door 130 in order to assist with sealing the openings 180 of freezer door 130, e.g., and hinder or prevent the foam insulation from leaking from freezer door 130 during curing of the foam insulation.

Inner housing 216 may be positioned within and mounted to outer housing 211. In particular, a fastener 262 may extend through inner housing 216 into outer housing 211 in order to removably mount inner housing 216 within outer housing 211. Thus, inner housing 216 may be removably mounted to outer housing 211, e.g., to permit servicing of articulation assembly 200. As may be seen in FIG. 5, inner housing 216 includes a pair of side walls 219. Side walls 219 may be spaced apart from each other, e.g., along the lateral direction L.

Housing assembly 210 also defines a pair of first slots 217 and a pair of second slots 218. As may be seen in FIGS. 5 and 7, inner housing 216 may define first and second slots 217 and 218. In particular, each side wall of side walls 219 may define a respective one of first slots 217 and a respective one of second slots 218. Thus, the slots of first slots 217 may be spaced apart from each other, e.g., along the lateral direction L. Similarly, the slots of second slots 218 may be spaced apart from each other, e.g., along the lateral direction L.

Articulation assembly 200 also includes a handle anchor 220. Handle anchor 220 includes a foot plate 226 and a post 228. A handle of an associated appliance may be mounted to and/or positioned on handle anchor 220. For example, first mounting foot 174 or second mounting foot 176 of handle 170 of freezer door 130 may be positioned on and/or mounted to handle anchor 220. In particular, first mounting foot 174 or second mounting foot 176 of handle 170 of freezer door 130 may be positioned on foot plate 226 of handle anchor 220 and engage post 228 in order to mount the first mounting foot 174 or second mounting foot 176 of handle 170 to handle anchor 220.

At least a portion of handle anchor 220 may be positioned between side walls 219 of inner housing 216 and mounted to inner housing 216. In particular, handle anchor 220 includes a pair of first projections 222 and a pair of second projections 224. First projections 222 and second projections 224 may extend, e.g., along the lateral direction L, towards inner housing 216. Each projection of first projections 222 is, e.g., slidably, received within a respective one of first slots 217 of housing assembly 210. Similarly, each projection of second projections 224 is, e.g., slidably, received within a respective one of second slots 218 of housing assembly 210. Thus, handle anchor 220 may be mounted to housing assembly 210 with first and second projections 222 and 224. In particular, handle anchor 220 may be mounted to housing assembly 210 such that handle anchor 220 is linearly movable and also pivotable within housing assembly 210, as discussed in greater detail below.

Inner housing 216 also includes features for assisting with mounting handle anchor 220 to inner housing 216. For example, inner housing 216 defines a guide channel 221 at each one of side walls 219 of inner housing 216. Guide channels 221 may extend, e.g., along the vertical direction V, between a top portion of inner housing 216 and second slots 218. Second projections 224 may be received within and slide down guide channels 221 from the top portion of inner housing 216 to second slots 218. Prior of positioning second projections 224 within second slots 218, first projections 222 may be rotated into first slots 217. Thus, second projections 224 may deflect or deform side walls 219 while positioned within guide channels 221 such that first projections 222 may be positioned within first slots 217. In such a manner, first and second projections 222 and 224 may be received within first and second slots 217 and 218 despite side walls 219 of inner housing 216 being assembled together prior to mounting handle anchor 220 to inner housing 216.

As may be seen in FIG. 5, inner housing 216 also includes stops 215. Each stop of stops 215 is positioned at and mounted to a respective side wall of side walls 219. Handle anchor 220 also includes stops 229. Stops 229 of handle anchor 220 engage stops 215 of inner housing 216, e.g., to hinder or prevent over pivoting or rotation of handle anchor 220 relative to inner housing 216. In particular, stops 229 of handle anchor 220 and stops 215 of inner housing 216 may be positioned or configured for hindering or preventing second projections 224 from impacting or damaging side walls 219 during movement of handle anchor 220 relative to inner housing 216.

Articulation assembly 200 further includes a cam or lever 230. Lever 230 is rotatably mounted to housing assembly 210. For example, lever 230 may be positioned between side walls 219 of inner housing 216, and a shaft 238 may extend between side walls 219, e.g., along the lateral direction L, through shaft 238, e.g., a hub 232 of lever 230. Thus, lever 230 may be rotatably mounted to inner housing 216 with shaft 238. As discussed in greater detail below, lever 230 couples various components of articulation assembly 200 together, e.g., to transfer motion therebetween.

Articulation assembly 200 additionally includes a slider assembly 240. Slider assembly 240 includes a slider arm 242 and a slide anchor 244. Slide anchor 244 may be slidably mounted to housing assembly 210, e.g., a top portion of inner housing 216. Slider arm 242 is slidably received within a channel 214 defined by housing assembly 210, e.g., outer housing 211. Slider arm 242 is mounted to the slide anchor 244 and may extend from the slide anchor 244 toward a cabinet of an associated appliance. For example, slider arm 242 may extend from slide anchor 244 to about the cabinet 120 of refrigerator appliance 100 (FIG. 1).

Slide anchor 244 may include features for assisting with aligning and/or mounting slider arm 242 with slide anchor 244. As may be seen in FIG. 5, slide anchor 244 defines or includes angled side walls 246. During assembly of articulation assembly 200, housing assembly 210 and slide anchor 244 may be positioned and mounted within a door, e.g., through a front panel of the door. Conversely, slider arm 242 may be inserted through a back panel of the door. Angled side walls 246 assist with properly aligning slider arm 242 with slide anchor 244 despite poor visibility of the components. In particular, a proximal end 248 of slider arm 242 may impact and slide along angled side walls 246 in order to guide proximal end 248 of slider arm 242 to a mounting feature 249 of slide anchor 244, such as a snap fit connection.

It should be understood that first and second projections 222 and 224 may be mounted to handle anchor 220 in any suitable manner. For example, handle anchor 220 and first and second projections 222 and 224 may be formed or molded from a single piece of material, e.g., a plastic, such that first and second projections 222 and 224 are integral or continuous with handle anchor 220. As another example, first and second projections 222 and 224 may be separate components mounted to handle anchor 220, e.g., threaded, welded, glued, etc. In particular, first projections 222 and second projections 224 may each be formed on a respective, shaft or rod that is mounted to and extends through handle anchor 220, e.g., along the lateral direction L.

Figure 9:
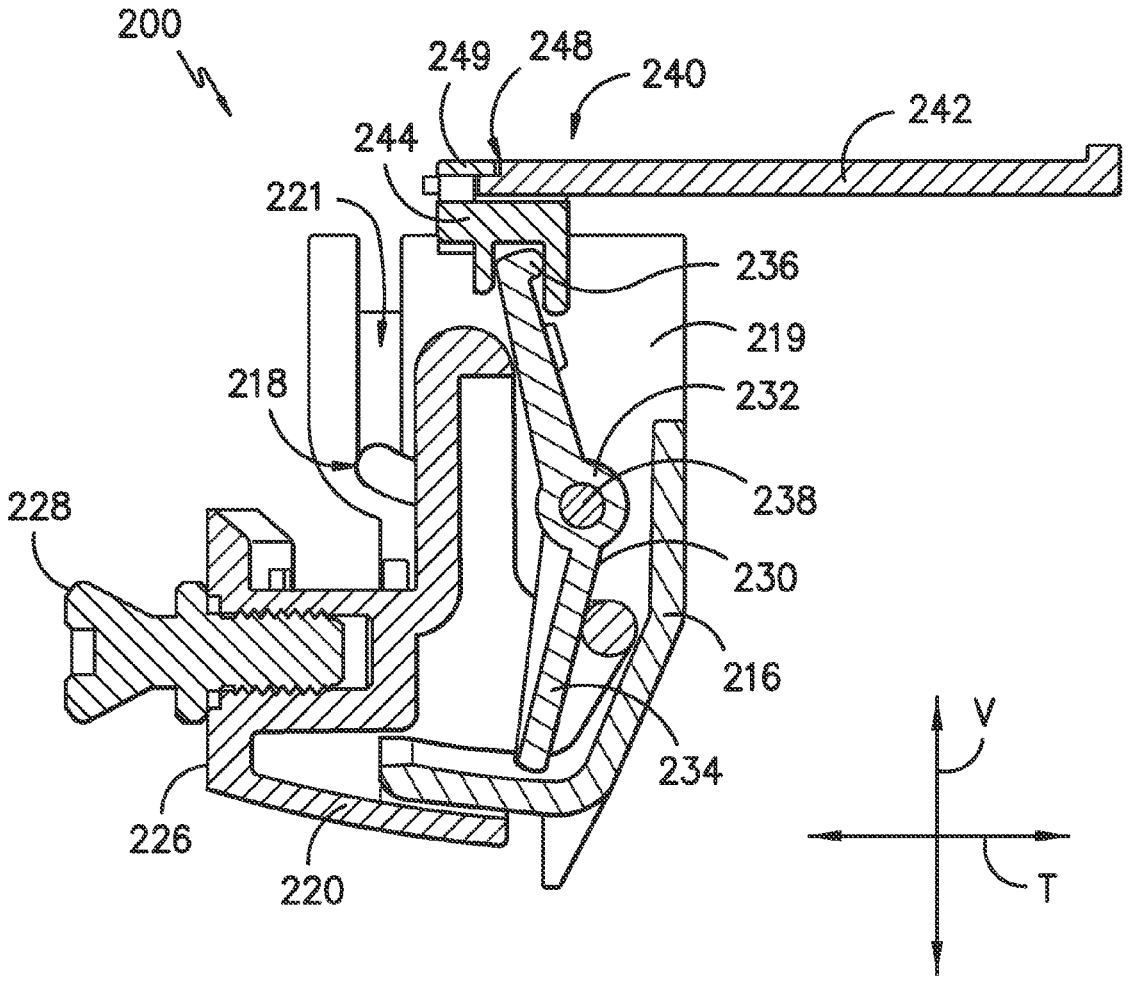
FIGS. 9 and 10 provide side, section views of the exemplary articulation assembly of FIG. 5 with a slider assembly of the exemplary articulation assembly shown in a retracted position and an extended position, respectively.
Figure 10:
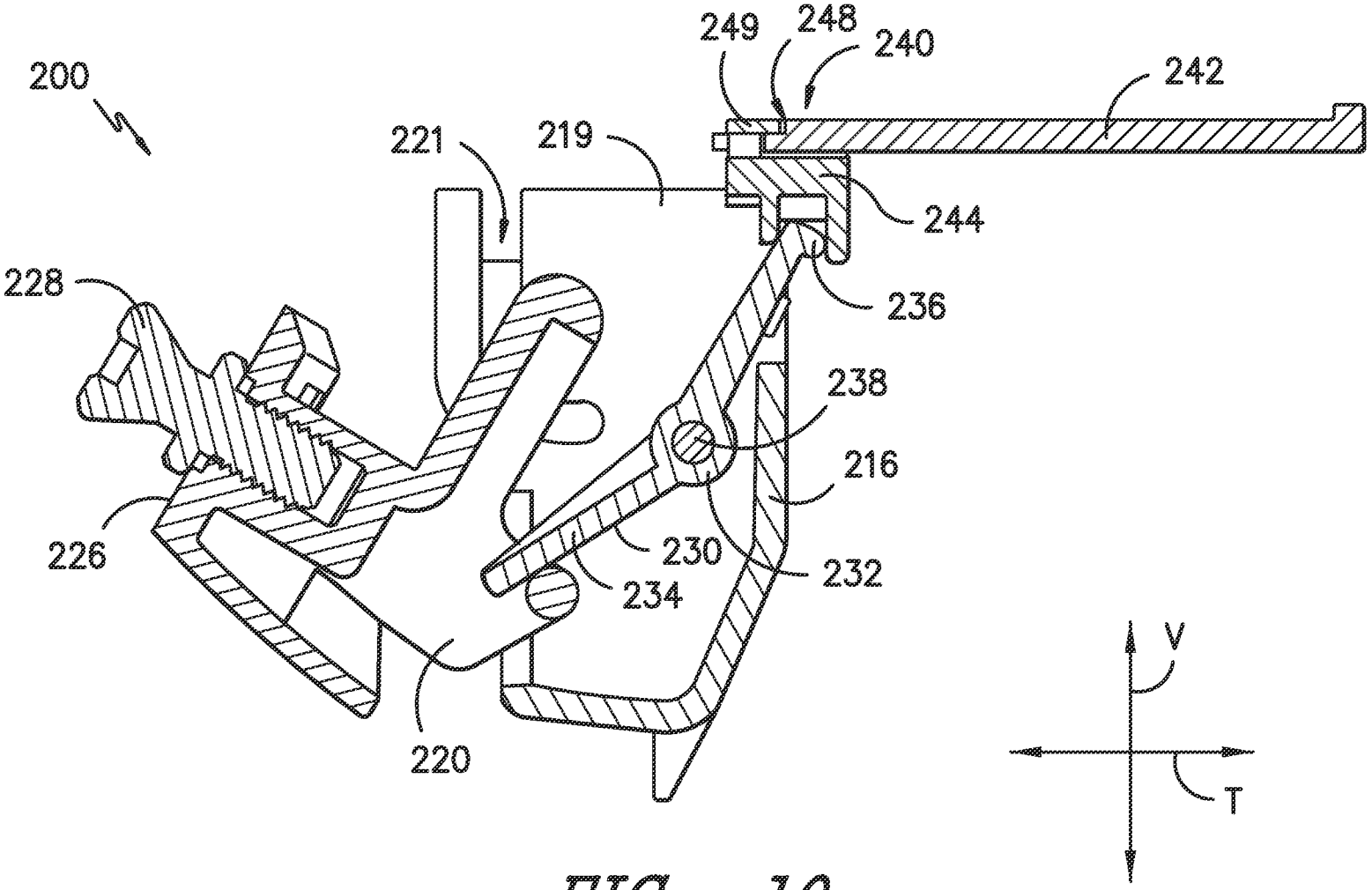
Figure 11:
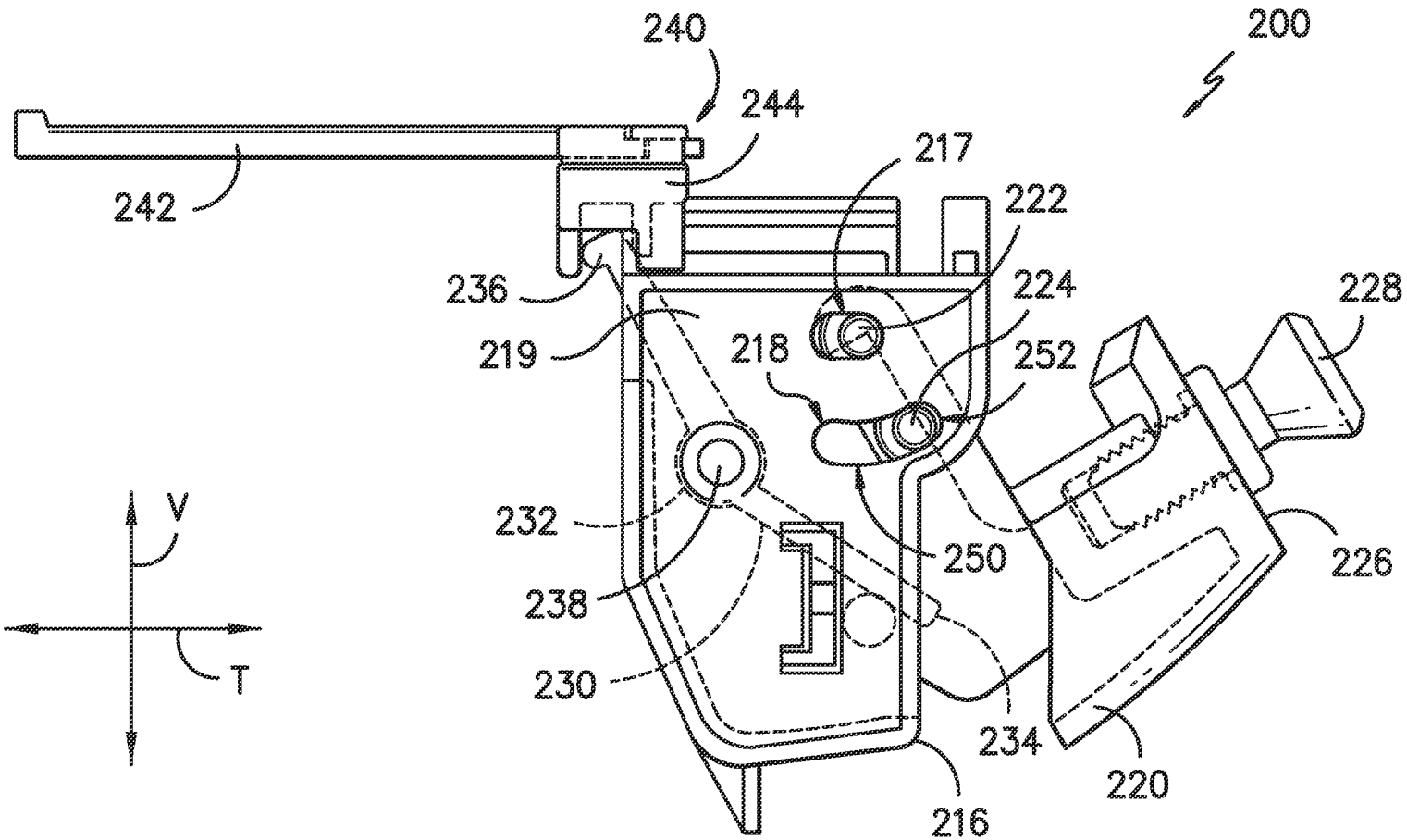
FIG. 11 provides a side, elevation view of the exemplary articulation assembly of FIG. 5 with the slider assembly of the exemplary articulation assembly shown in the extended position.

FIGS. 9 and 10 provide side, section views of articulation assembly 200 with slider assembly 240 shown in a refracted position and an extended position, respectively. FIG. 11 provides a side, elevation view of articulation assembly 200 with slider assembly 240 shown in the extended position. Slider assembly 240 is coupled to handle anchor 220, e.g., such that pivoting of handle anchor 220 adjusts or shifts slider assembly 240 between the retracted position and the extended position. When slider assembly 240 shifts from the retracted position towards the extended position, slider arm 242 moves or slides within channel 214 of outer housing 211 towards a cabinet of an associated appliance. When slider arm 242 contacts or engages the cabinet, slider arm 242 assists with opening a door of the associated appliance as discussed in greater detail below.

As may be seen in FIGS. 9 and 10, slider assembly 240 is coupled to handle anchor 220 via lever 230. Thus, lever 230 may be coupled to handle anchor 220 and slider assembly 240. In particular, lever 230 may include a hub 232, a first lever arm 234 and a second lever arm 236. First and second lever arms 234 and 236 are mounted to hub 232 and extend away from hub 232. For example, first lever arm 234 may extend from hub 232 to handle anchor 220 and be coupled to handle anchor 220, and second lever arm 236 may extend from hub 232 to slider assembly 240 and be coupled to slider assembly 240, e.g., slide anchor 244 of slider assembly 240. By coupling handle anchor 220 and slider assembly 240 together, lever 230 may assist with transferring motion of handle anchor 220 to slider assembly 240. Thus, slider assembly 240 may be actuated between the retracted position and the extended position via lever 230 by pivoting or rotating a handle of an associated appliance. A biasing mechanism 264 (FIG. 5), such as a coil spring, may be coupled or mounted to lever 230 or handle anchor 220 (e.g., and housing assembly 210) in order to bias or urge slider assembly 240 towards the refracted position.

As discussed above, a handle of an associated appliance may be mounted to handle anchor 220, and handle anchor 220 is mounted to housing assembly 210. In particular, handle anchor 220 may be mounted to housing assembly 210 with first and second projections 222 and 224 that are received within first and second slots 217 and 218, respectively. Motion of handle anchor 220 during pivoting of the handle of the associated appliance may be guided by first and second slots 217 and 218, as discussed in greater detail below.

Turning back to FIG. 7, second slots 218 may be positioned below first slots 217, e.g., along the vertical direction V. Thus, second projections 224 may be positioned below first projections 222, e.g., along the vertical direction V. Each slot of second slots 218 includes a linear portion 250 and an arcuate portion 252, e.g., that are contiguous with each other. The linear portion 250 of second slots 218 may be oriented such that the linear portions 250 of second slots 218 extend along the transverse direction T and/or are substantially level along the transverse direction T. Thus, the linear portion 250 of second slots 218 may be horizontally oriented. In addition, each linear portion 250 of second slots 218 may be substantially parallel to a respective slot of the first slots 217.

As may be seen in FIG. 7, second projections 224 are positioned or received within linear portion 250 of second slots 218 when slider assembly 240 is in the retracted position. In addition, each linear portion 250 of second slots 218 may be positioned, e.g., directly below a respective slot of the first slots 217, e.g., along the vertical direction V. Thus, first and second projections 222 and 224 may be, e.g., substantially aligned along the vertical direction V, when slider assembly 240 is in the retracted position.

Turning now to FIG. 11, second projections 224 are positioned or received within arcuate portion 252 of second slots 218 when slider assembly 240 is in the extended position. In addition, first and second projections 222 and 224 may be, e.g., misaligned along the vertical direction V, when slider assembly 240 is in the extended position. Thus, with reference to FIGS. 7 and 11, when a handle of an associated appliance is grasped by a user of the appliance, the user may pull the handle such that handle anchor 220 moves along the transverse direction T. In particular, first and second projections 222 and 224 may guide motion of handle anchor 220 by sliding within first slots 217 and linear portion 250 of second slots 218, respectively. First projections 222 may slide within first slots 217 until first projections 222 impact inner housing 216 at an end of first slots 217. With first projections 222 positioned against inner housing 216 as shown in FIG. 11, further linear translation of first projections 222 within first slots 217 is hindered or prevented. Thus, further linear translation of handle anchor 220 is similarly hindered or prevented, and handle anchor 220 is pivoted, e.g., about first projections 222. In particular, second projections 224 enter and slide within arcuate portion 252 of second slots 218 when first projections 222 are positioned at an end of first slots 217 as shown in FIG. 11. Handle anchor 220 may continue to pivot and second projections 224 may continue to slide within arcuate portion 252 of second slots 218 until second projections 224 impact inner housing 216 at an end of second slots 218. In such a manner, first and second slots 217 and 218 can assist with permitting handle anchor 220 to linear translate and pivot.

By linear translating, e.g., away from housing assembly 210, a visible gap between a door of an associated appliance and a handle of the associated appliance can be reduced. Thus, a cosmetic appearance of the associated appliance can be improved. As an example, a gap between handle 170 and opening trims 182 of freezer door 130 may be reduced and a cosmetic appearance of freezer door 130 may be improved. In addition, first and second mounting feet 174 and 176 may be further recessed within freezer door 130 by providing for linear translation of handle anchor 220, e.g., away from housing assembly 210.

As may be seen in FIG. 7, each linear portion 250 of second slots 218 has a length L2, e.g., along the transverse direction T, and each slot of first slots 217 also has a length L1, e.g., along the transverse direction T. The length L1 of first slots 217 and the length L2 of linear portion 250 of second slots 218 may be any suitable lengths. For example, the length L1 of first slots 217 may be about equal to the length L2 of linear portion 250 of second slots 218. Thus, a total length of second slots 218 may be greater than the length L1 of first slots 217, as shown in FIG. 7.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a cabinet defining an interior volume;

a door mounted to the cabinet such that the door permits selective access to the interior volume of the cabinet, the door having an outer panel that defines an opening;

a handle; and an articulation assembly comprising a housing assembly positioned within the door at the opening of the outer panel, the housing assembly defining a first pair of slots and a second pair of slots, each slot of the second pair of slots including a linear portion and an arcuate portion, the linear portions of the second pair of slots being parallel with the slots of the first pair of slots;

a handle anchor positioned within the housing assembly between the first and second pairs of slots of the housing assembly, the handle anchor having a first pair of projections and a second pair of projections, each projection of the first pair of projections received within a respective one of the first pair of slots of the housing assembly, each projection of the second pair of projections received within a respective one of the second pair of slots of the housing assembly, the handle mounted to the handle anchor;

a lever rotatably mounted to the housing assembly and coupled to the handle anchor; and a slider assembly coupled to the lever and extending towards the cabinet.

2. The appliance of claim 1, wherein the housing assembly comprises:

an outer housing disposed within the door and secured to the door;

an inner housing received within the outer housing, the inner housing defining the first and second pairs of slots.

3. The appliance of claim 2, wherein the housing assembly further comprises a fastener extending through the inner housing into the outer housing in order to removably mount the inner housing within the outer housing.

4. The appliance of claim 2, wherein the inner housing has a pair of side walls, the handle anchor and the lever positioned between the side walls of the pair of side walls, each side wall of the pair of side walls defining a respective one of the first pair of slots and a respective one of the second pair of slots.

5. The appliance of claim 4, wherein the housing assembly further comprises a shaft that extends between the side walls of the pair of side walls, the lever rotatably mounted to the inner housing with the shaft.

6. The appliance of claim 1, wherein each linear portion of the second pair of slots has a length and each slot of the first pair of slots also has a length, the length of each slot of the first pair of slots being about equal to the length of each linear portion of the second pair of slots.

7. The appliance of claim 1, wherein each linear portion of the second pair of slots is positioned directly below a respective slot of the first pair of slots.

8. The appliance of claim 1, wherein the second pair of slots is positioned below the first pair of slots.

9. The appliance of claim 1, wherein the lever comprises a hub, a first lever arm and a second lever arm, the first and second lever arms mounted to the hub and extending away from the hub, the first lever arm coupled to the handle anchor, the second lever arm coupled to the slider assembly.

10. The appliance of claim 1, wherein the slider assembly comprises a slider arm and a slide anchor, the slide anchor slidably mounted to the housing assembly and coupled to the lever, the slider arm received within a channel defined by the housing assembly such that the slider extends from the slide anchor to about the cabinet.

11. The appliance of claim 9, wherein the slider arm slides towards and engages the cabinet to urge the door towards and open position when the handle is pivoted.

12. The appliance of claim 1, wherein the appliance is a bottom mount refrigerator appliance and the door is a freezer door of the bottom mount refrigerator appliance.

13. A bottom mount refrigerator appliance, comprising:

a cabinet defining an upper fresh food chamber and a lower freezer chamber;

a freezer door positioned at the lower freezer chamber of the cabinet, the freezer door having an outer panel that defines an opening;

a handle; and an articulation assembly comprising a housing assembly positioned within the freezer door at the opening of the outer panel, the housing assembly defining a first pair of slots and a second pair of slots, each slot of the second pair of slots including a linear portion and an arcuate portion, the linear portions of the second pair of slots being parallel with the slots of the first pair of slots;

a handle anchor positioned within the housing assembly between the first and second pairs of slots of the housing assembly, the handle anchor having a first pair of projections and a second pair of projections, each projection of the first pair of projections received within a respective one of the first pair of slots of the housing assembly, each projection of the second pair of projections received within a respective one of the second pair of slots of the housing assembly, the handle mounted to the handle anchor;

a lever rotatably mounted to the housing assembly and coupled to the handle anchor; and a slider assembly coupled to the lever and extending towards the cabinet.

14. The appliance of claim 13, wherein the housing assembly comprises:

an outer housing disposed within the freezer door and secured to the freezer door;

an inner housing received within the outer housing, the inner housing having a pair of side walls, the handle anchor and the lever positioned between the side walls of the pair of side walls, each side wall of the pair of side walls defining a respective one of the first pair of slots and a respective one of the second pair of slots.

15. The appliance of claim 14, wherein the housing assembly further comprises a shaft that extends between the side walls of the pair of side walls, the lever rotatably mounted to the inner housing with the shaft.

16. The appliance of claim 13, wherein each linear portion of the second pair of slots has a length and each slot of the first pair of slots also has a length, the length of each slot of the first pair of slots being about equal to the length of each linear portion of the second pair of slots.

17. The appliance of claim 13, wherein each linear portion of the second pair of slots is positioned directly below a respective slot of the first pair of slots.

* * * * *